United States Patent [19]

Sonck

[11] Patent Number: 4,696,597

[45] Date of Patent: Sep. 29, 1987

[54] EQUIPMENT FOR CARRYING OUT WORK, UNDER DRY CONDITIONS, ON AN UNDERWATER STRUCTURE

[75] Inventor: Willy Sonck, Denderleeuw, Belgium

[73] Assignee: General Coatings, Denderleeuw, Belgium

[21] Appl. No.: 866,120

[22] Filed: May 22, 1986

[30] Foreign Application Priority Data

May 29, 1985 [BE] Belgium ..... 215094
Sep. 11, 1985 [BE] Belgium ..... 215568

[51] Int. Cl.[4] ..... B63C 11/00; B63C 11/40

[52] U.S. Cl. ..... 405/12; 405/13

[58] Field of Search ..... 405/11-14; 114/227

[56] References Cited

U.S. PATENT DOCUMENTS 704,905 7/1902 McLaughlin ..... 114/227
936,638 10/1909 Kirk ..... 405/14
1,060,177 4/1913 Flügeltaub ..... 405/12
2,166,865 7/1939 Gerdes ..... 405/12
3,611,968 10/1971 Takezawa ..... 405/13 X
3,768,265 10/1973 Brouillette ..... 405/12
3,849,996 11/1974 Mittleman ..... 405/12

*Primary Examiner*—Dennis L. Taylor
*Assistant Examiner*—Nancy J. Stodola
*Attorney, Agent, or Firm*—Fitch, Even, Tabin & Flannery

[57] ABSTRACT

This invention concerns equipment designed for carrying out work under dry conditions on an underwater structure in particular on a sheet pile planking wall with grooves at more or less regular intervals comprising a caisson brought through two vertical walls and a floor in contact with a sheet pile planking wall and means to keep the caisson pressed against the sheet pile planking wall comprising the floor of the caisson being fitted with horizontally adjustable sealing sheets that slide in the grooves of the sheet pile planking wall.

5 Claims, 11 Drawing Figures

EQUIPMENT FOR CARRYING OUT WORK, UNDER DRY CONDITIONS, ON AN UNDERWATER STRUCTURE

This invention concerns equipment for carrying out work, under dry conditions, on an underwater structure featuring a non-flat surface, specifically on a sheet pile planking wall displaying grooves at more or less regular intervals.

It is quite difficult, if not impossible, to work on sheet pile planking walls under water. Because of the cross-section profile of the sheet piles, it was not possible up to now to work on a sheet pile planking wall under dry conditions, e.g. to repair, rid of growth, paint-coat or provide such walls with a coating.

The purpose of the invention consists in describing equipment and a method that will make it possible, with rather simple technical means, to make use of a caisson from which the water has been removed so that the work required can be carried out over a specific length of the sheet pile planking wall and so that this work can be repeated until the entire length of the sheet pile planking wall has been completely processed.

In order to make such work possible, equipment is used that is formed by a caisson that can be brought into contact with the sheet pile planking wall through two vertical walls and a floor, by means designed to hold the caisson, before it is pumped empty, pressed against the sheet pile planking wall, with the floor of the caisson fitted with horizontally adjustable sealing sheets that slide into the vertical grooves of the sheet pile planking wall and with the edges of both the vertical walls and of the floor of the caisson as well as the edges of the aforesaid sliding sealing sheets lined with strips of foam rubber or of a similar elastic sealing material.

Still according to the invention, there are means provided to displace the lateral walls of the aforesaid sealing sheets in the direction of the side flanks of the aforesaid grooves of the sheet pile planking wall.

According to a noteworthy embodiment, the aforesaid means are formed by rectangular casings fitted within the sealing sheets one for each lateral wall of each sealing sheet. On each casing a block made, for instance, of wood has been assembled suitably, along the outside of which has been glued a strip of foam rubber or of a similar elastic sealing material, whereas along the inside of this block in the aforesaid casing, an inflatable air chamber is fitted that will push, with increasing volume, the aforesaid block out of the casing and keep it pressed against the side flanks of the aforesaid grooves.

The invention also concerns equipment of carrying out work under dry conditions on an underwater structure featuring a flat or nearly flat surface or formed by sheet piles, the wings of which form an angle of nearly 70° or less with a vertical plane.

Where an underwater structure such as a quay wall or a sheet pile planking wall with a flat or almost flat surface or the sheet pile wings of which form an angle with the vertical plane of nearly 70° or less, has to be processed, use may be made of equipment based on the principles that support the aforesaid embodiment and which equipment displays just a few useful variations.

In order to be able to carry out work under dry conditions in similar circumstances, the equipment according to the invention consists of a caisson with a vertical open side, of means to keep this caisson with the edge of its floor and two side walls pressed against the aforesaid structure and of sealing means that are part of the caisson and designed to fill the space between the aforesaid walls and the aforesaid structure.

Still according to the invention, the aforesaid means designed to keep the aforesaid caisson pressed against the aforesaid structure consist of a stretching device such as e.g. tackles designed to stretch a link such as a cable or chain between a fixing point at the caisson and a fixing point at the aforesaid structure.

In a preferred embodiment, the aforesaid sealing means consist of an inflatable hollow profile to which is fitted, if required, a strip made of elastic material directed in operating position toward the aforesaid structure.

In a specific case where the aforesaid structure consists of sheet piles, the wings of which form an angle of nearly 70° or less with the vertical plane, the sealing means consist of sheets designed to fit the cross profile of the aforesaid sheet piles, on the side that is kept pressed against the aforesaid sheet pile planking wall. These sheets are fitted, if required, with elastic sealing material.

Further details and advantages of the invention will be shown by the following description of equipment and of a method according to the invention. This description is given as an example only and does not restrict the invention. The reference Figures relate to the drawings appended hereto.

Figure 1:
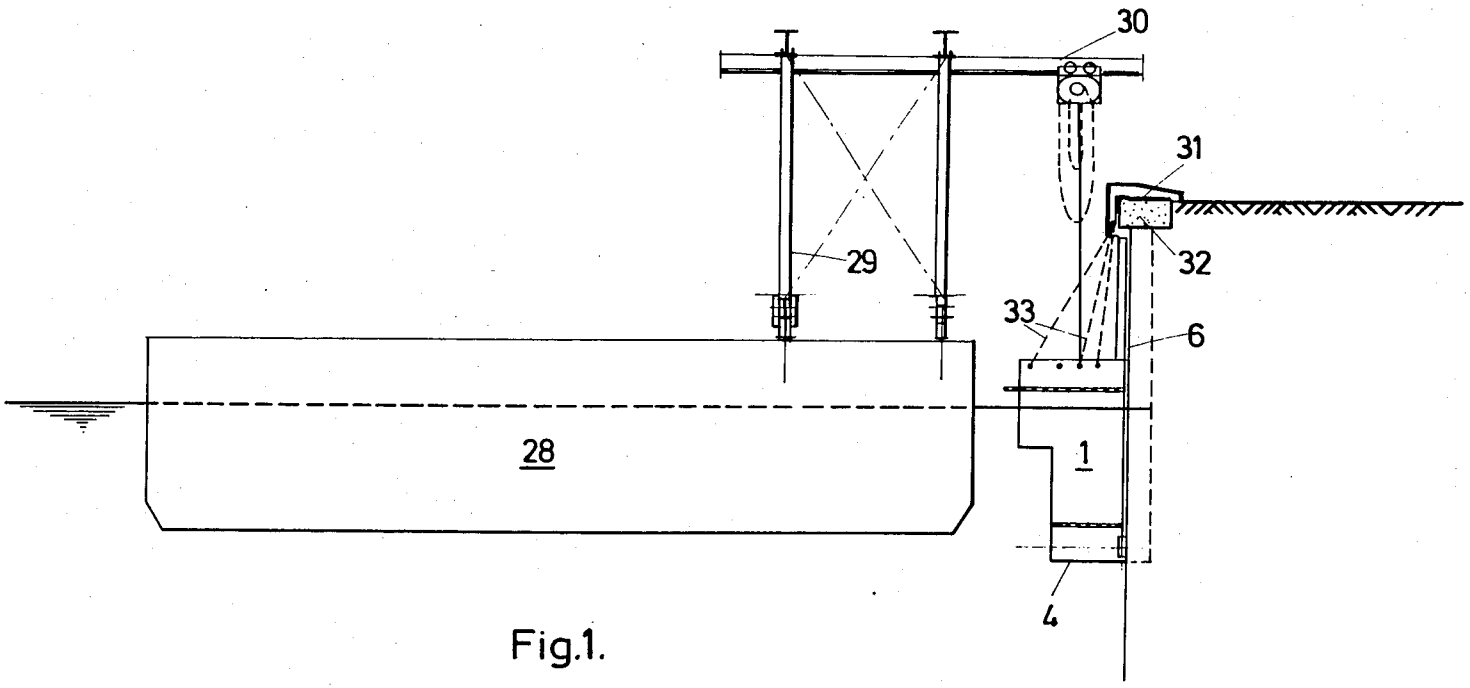
FIG. 1 is a diagrammatic presentation of the disposition of a caisson against a sheet pile planking wall, using a pontoon.
Figure 2:
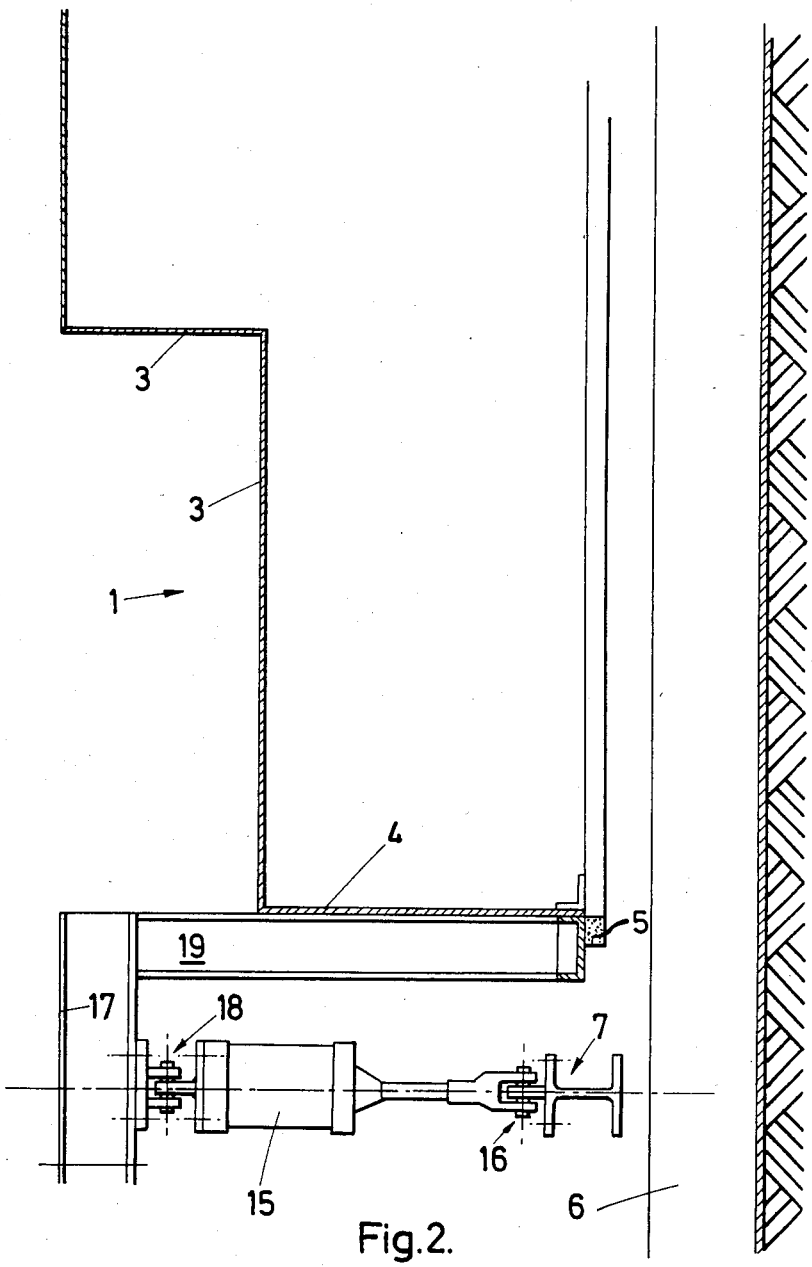
FIG. 2 is a presentation, on a larger scale, of the anchoring of the equipment against a sheet pile planking wall.
Figure 3:
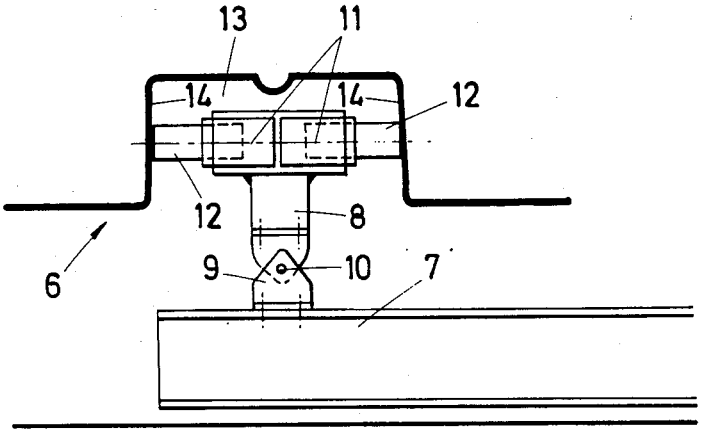
FIG. 3 shows, on the same scale, one detail of the equipment according to the invention.
Figure 5:
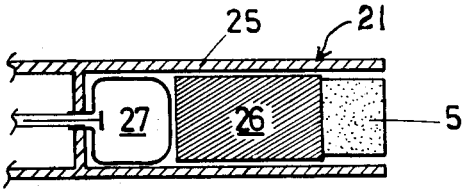
FIG. 5 shows according to a cross-section taken substantially along line A—A in FIG. 4, the rectangular casing with inside a suitably assembled wood block with the inflatable chamber designed to push this block out of the casing.
Figure 4:
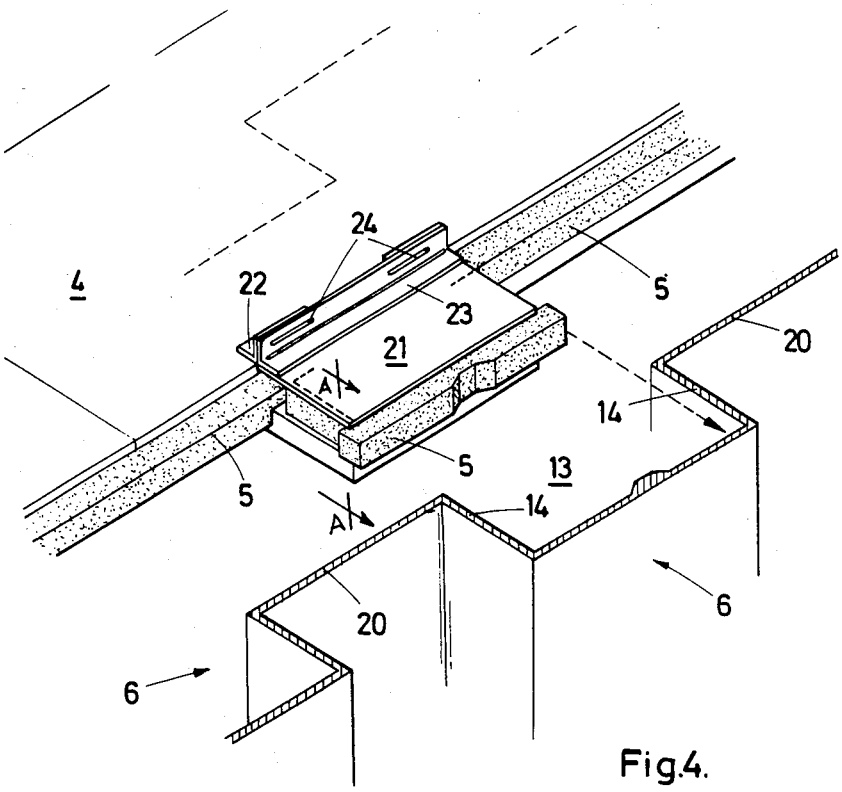
FIG. 4 shows diagrammatically and in perspective a sealing sheet sliding out against a groove in a sheet pile planking wall.
Figure 6:
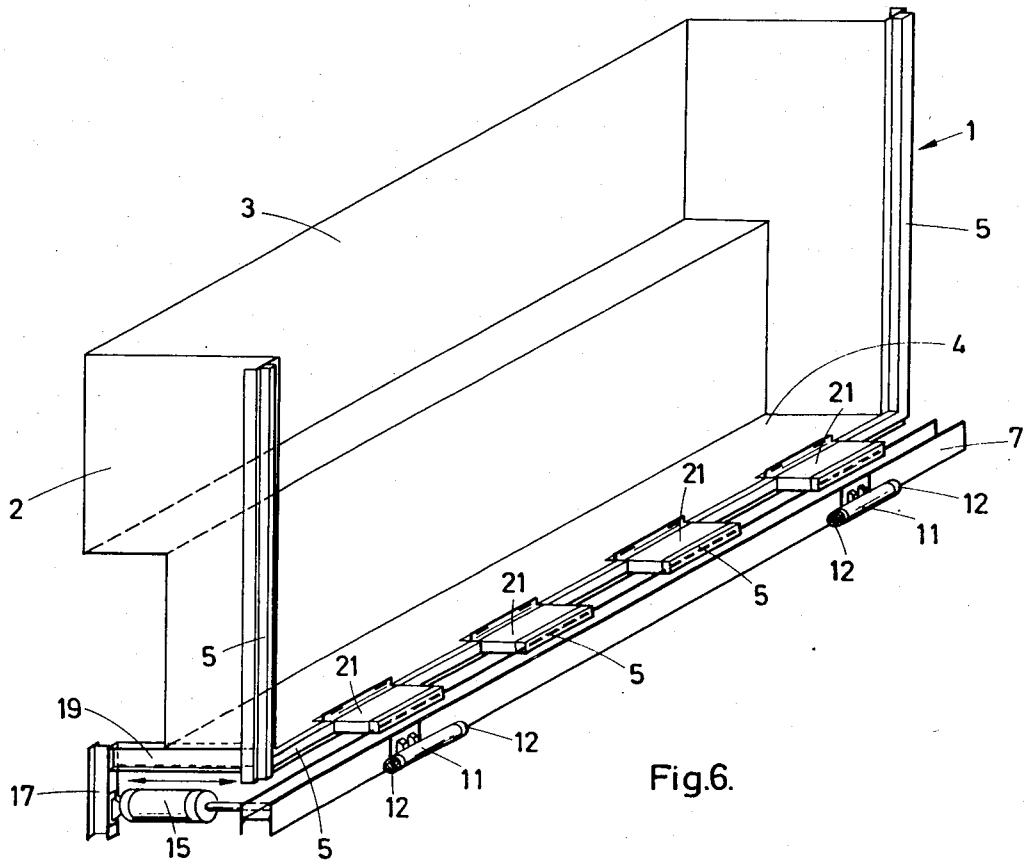
FIG. 6 shows a general presentation in perspective of equipment according to one embodiment of the invention.

The equipment according to the invention consists of one caisson 1 with three vertical walls i.e. two lateral walls 2 and one rear wall 3. Along the front side (meaning the side directed toward the sheet pile planking wall to be processed), the caisson is open.

The edges of the lateral walls 2 and the edge of the floor 4 are lined with strips 5 made of foam rubber or a similar elastic sealing material.

In order to make it possible to press and keep pressed the floor 4 of the caisson 1 watertight against a sheet pile planking wall 6, a special structure of this floor, described in detail further on, has been designed. Keeping the caisson 1 pressed against the sheet pile planking wall 6 is made possible by the component parts and elements described below and that are very characteristic for the invention itself.

Underneath the floor 4 of the caisson 1, a beam 7 will be suspended in such a manner as to allow for transverse displacement as compared to floor 4 of caisson 1. The beam 7 will be secured to the sheet pile planking wall by means of links 8 and 9 interconnected in a slightly hinged manner in 10.

Link 8 is connected solidly with the jacks 11. Two plungers 12 emerging from these jacks 11 will be pressed into a groove 13 of a sheet pile (actually against its side flanks 14) by hydraulic or pneumatic means. The anchoring of links 8 and 9 on the sheet pile planking wall results from the manner in which the plungers 10 are kept firmly pressed against the side flanks 12 in a groove 13 that is part of a sheet pile planking wall.

Through this anchoring, we may consider that the beam 7 is also anchored to the sheet pile planking wall 6.

On the beam secured in this manner to the sheet pile planking wall 6, a series of jacks are fixed. Four jacks are sufficient for a caisson almost 3.8 meters wide. Drawing 2 shows one of these jacks under reference 15.

The hinged link with beam 7 is referred to under 16 and that with a small beam 17 under 18. For each jack is also provided a small beam 17 that is solidly connected, in turn, with a horizontal small beam 19 secured solidly to floor 4 of the caisson 1.

Thus, for a floor width of almost 3.8 meters, four small beam 19 are provided for, on which a small beam 19 is fixed in each case, so that the link between the four jacks and the beam 7 is provided by four complexes of small beams 17 and 19.

By referring to drawings 2 and 3, we can thus easily see that pulling the caisson 1 against the sheet pile planking wall 6 can be achieved easily under a tractive force provided by the jacks 15 and applied to the small beams 17–19. Because of the presence at the edges of the vertical walls 2 and at the edge of the floor 4 of strips 5 made of foam rubber or a similar elastic sealing material, a caisson can thus be kept pressed watertight against a sheet pile planking wall, provided the link between the floor 4 and the sheet pile planking wall is also kept watertight.

This watertight link is made possible by a structure that is also very typical for the invention and of which the drawings 4 and 5 provide a clear picture.

Drawing 4 shows the floor 4 of the caisson 1 clearly. The front side i.e. the side or edge in contact with the general surface of the sheet pile planking wall is lined with the aforesaid strips 5 made of foam rubber or a similar elastic material.

The surface area of the sheet pile planking wall with which the front side or free edge of the floor 4 of the rising vertical walls 2 are in contact, is determined by the flat walls 20 of the sheet pile planking wall pointed out clearly under reference 6.

Considering that the standardized sizes of sheet pile planking walls are known, a sliding-out sealing sheet 21 has been provided for at specific intervals along the front side or free edge of the floor 4 of the caisson 1, at each groove of a sheet pile. In this context we may refer to drawing 6 where the four sealing sheets 21 of the caisson 1 are shown. In order to obtain a perfect seal of these sheets 21 against the three walls of the groove 13 of a sheet pile, the structure below has been designed.

To the floor 4 has been fixed an angle bar 22. An angle bar 23 is also fitted to each sealing sheet 21. One of these angle bars, at least, has slots 24 so that the sealing sheets 21 can be moved to their proper place in relation to the grooves 13 by means of a nut and bolt system not presented here.

This process takes place before the caisson is pressed against the sheet pile planking wall and before it is emptied by pumping. Along the front side i.e. the side directed toward the sheet pile planking wall 6, a strip of foam rubber 5 has been fitted with the necessary longitudinal profile. This strip 5 projects laterally slightly from the sheet 21. When the sealing sheet 21 slides into the groove 13 while the caisson is moved in the direction of the sheet pile planking wall 6, this strip 5 thus makes contact with the floor or flat wall of the groove 13. The lateral sealing of the sheet 21 against the side walls 14 of the sheet pile is also provided with foam rubber strips 5. These strips 5 are pressed against the side walls 14 after the caisson has been firmly pressed against the sheet pile planking wall by means of the aforesaid jacks.

In order to press the strips 5 laterally against the side walls 14, we use a structural design shown by drawing 5.

For each lateral side of the sealing sheet 21, this construction has a rectangular casing 25 into which a matching block 26 e.g. made of wood, has been pushed. The aforesaid strip 5 is fitted at the outer side of this block 26. This block 26 with its strip 5 is pushed outward by compressed air being blown into the inflatable air chamber 27 that adjusts very well to any possible slanting position of block 26 in the casing 25. The pressure in the air chamber 27 is easily adjustable and thus the pressure of the foam rubber strips 5 against the walls 14 can be adjusted too. This system makes possible a completely watertight seal between the sheet pile and the sealing sheet 21 and therefore also for the floor 4 of the caisson. Block 26 as shown by the drawing may also be designed as one unit with the strip 5, all made of an elastic material such as foam rubber. Adjusting the sealing sheets 21 watertight against the sheet pile wall is achieved after the caisson itself has been pulled against this sheet pile planking wall but before the caisson is emptied by pumping, at least where the lateral seals of the sheets 21 are concerned, considering the sealing at the front side takes place simultaneously with the watertight sealing of the floor 4 of the caisson and of the latter's vertical walls in consequence of the caisson being pulled against the sheet pile planking wall.

The description above of the equipment and of the method for using it shows its very significant advantages, namely the flexibility of both the equipment and the method. The advantages of adjusting the equipment to the greatly differing cross profiles of a sheet pile planking wall are obvious, as the sealing sheets 21 can be replaced very easily and any specific sheet pile profile corresponds each time easily with a matched sealing sheet profile.

Finally while drawing 1 presents the use of a pontoon 28 with a roll bridge 29 and a travelling crab 30, it is obvious that under certain conditions, the caisson can be moved also along the sheet pile planking wall 6 from the floor. Sinking the caisson can thus be carried out from outside the water by using aforesaid pontoon, but this can possibly take place from a bank. The same drawing 1 shows a clutch 31 fitted to the head beam of the sheet pile planking wall 6. The caisson is connected by cables 33 with this clutch 31.

The equipment is thus designed for carrying out work under dry conditions on a structure that is partly or completely underwater such as a quay wall or a sheet pile planking wall, in particular a sheet pile planking wall of which the sheet pile wings form with the vertical plane an angle of less than 70°.

Where such a sheet pile planking wall or a flat quay wall is involved, use cannot be made of the anchoring means as hereabove described. The sealing means for the caisson against the quay wall or sheet pile planking wall, referred to below mostly as the structure, may also be subject to significant changes.

In the drawings, the structure is generally referred to under 41. It consists of sheet piles that form a sheet pile planking wall profile with a slanting side wall thanks to the use of sheet piles of which the wings 42 form an angle of e.g. nearly 50° with a surface that may be considered, in the operating position, as the vertical plane. The floor sections 43 and 44 of the sheet pile run in parallel with this vertical plane.

Figure 9:
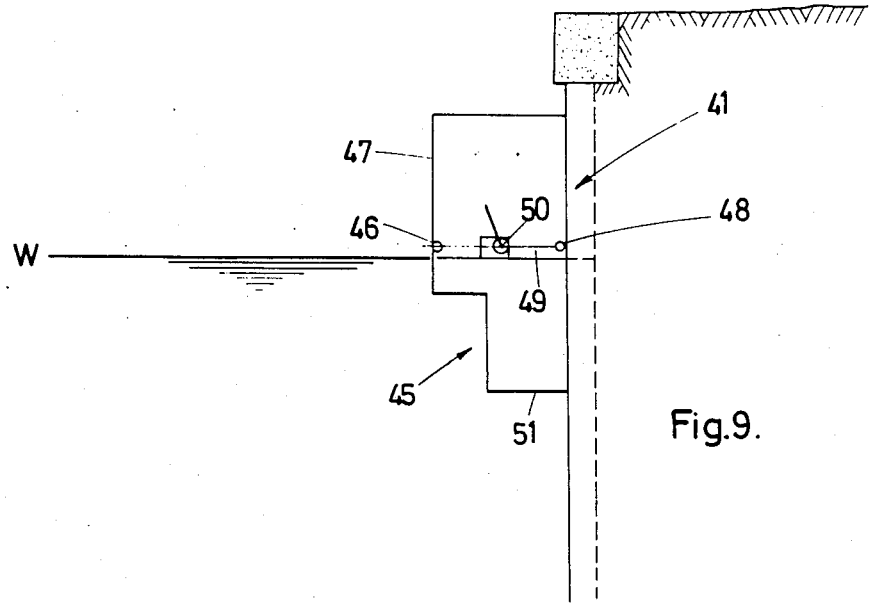
FIG. 9 is a diagrammatic vertical section of equipment according to a second embodiment of the invention pressed against a structure to be processed.

Unless this sheet pile planking wall displays locally a section for hooking in traction cables needed for keeping the caisson 45 (FIG. 9) pressed against this wall, fixation points 46 are provided at or near the waterline W at the inner side of the vertical wall 47 of the caisson and 48 at the structure 41 (FIG. 9) to be processed.

Between the fixation points 46 and 48 is stretched a cable or chain 49 by using a tackle or a suitable stretching device 50.

Figure 10:
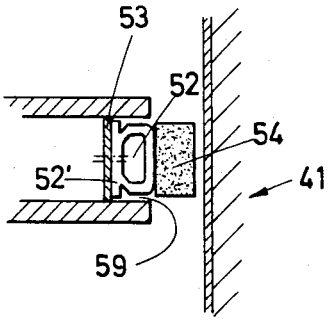
FIG. 10 shows on a large scale and according to a diagrammatic vertical sectional view, a sealing profile with housings adjusted according to the invention, in the position where the profile is not pressed against the structure to be processed.
Figure 11:
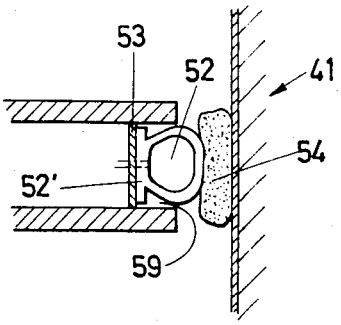
FIG. 11 shows on a larger scale and according to a diagrammatic vertical sectional view, a sealing profile with housings adjusted according to the invention, in the position where the profile is kept pressed against the structure to be processed.

If the structure to be processed is a flat or almost flat quay wall, it will be sufficient to use a continuous inflatable hollow profile 52 (FIG. 10 and 11) for the seal between the front-most edge of the floor 51 of the caisson 45 and the edges of the rising wall.

The continuous inflatable hollow profile 52 is connected with its heel section 52' to a supporting plate 53 inside the continuous hollow chamber 60. On the outer side, the continuous hollow profile 52 may carry a continuous strip 54 made of elastic sealing material. Foam rubber is one of the materials very well suited for this purpose. When the hollow profile 52 is being inflated, it changes its shape toward the outside and presses, together with the foam rubber strip 54 or not, in this manner against the structure 55.

The continuous inflatable hollow profile 52 extends over the entire length of the edges to be sealed, both at the floor 51 and at the vertical edges of the caisson 45.

Figure 7:
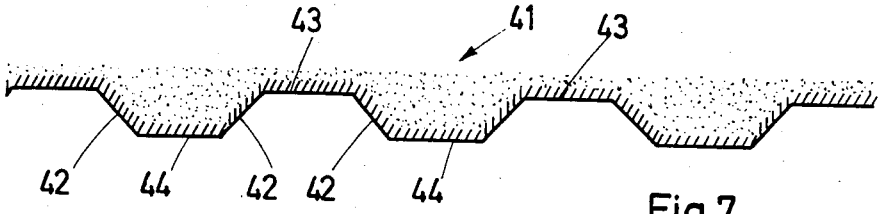
FIG. 7 is a sectional view through a sheet pile planking wall, the sheet pile wings of which form an angle of nearly 50° with the horizontal plane.
Figure 8:
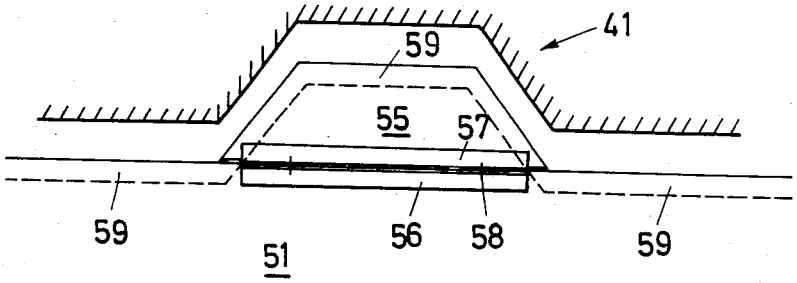
FIG. 8 is, on a larger scale, a sectional view through a sheet pile groove with, in plan view, part of the floor of the equipment according to the invention.

It is obvious that under certain conditions, it may be sufficient to provide these edges with a continuous foam rubber strip that achieves the seal required under the stretching of the aforesaid cable or chain 49, obtained by means of the tackle 50.

Where a sheet pile planking profile of the type shown by FIGS. 7 and 8 is involved, the floor 51 of the caisson 45 may be fitted locally with sealing sheets 55, that are adjustable in one direction, by using the angle bars 56 and 57. One of these angle bars has longitudinal slots through which adjusting screws 58 are passing. Both the outer edge of the sealing sheets 55 and the adjacent edges of the floor and the side flanks of the caisson are fitted either just with foam rubber strips 54, for example, or with sealing means as presented in the FIGS. 10 and 11.

Obviously the invention is not restricted to the embodiment described above and many changes may be applied thereto without exceeding the limits of the application.

I claim:

1. Equipment for carrying out work under dry conditions on an underwater structure having a generally vertical surface with substantially vertical grooves formed therein at predetermined intervals, said equipment comprising:

a caisson having two vertical walls and a floor, means to keep the caisson pressed against the underwater structure before the caisson is emptied by pumping, and a plurality of horizontally adjustable sealing sheets supported by said floor, said horizontally adjustable sealing sheets being extendable into said substantially vertical grooves, said vertical walls and floor having exposed edges lined with strips made of an elastic sealing material, said sealing sheets also having exposed edges lined with strips made of an elastic sealing material.

2. Equipment in accordance with claim 1 further comprising adjustable support means attaching said sealing sheets to said floor, said adjustable support means including angle bars on said floor adjacent and parallel to the exposed edge of said floor, and cooperating angle bars on said sealing sheets adjustably connected to said angle bars on said floor to enable horizontal movement of said sealing sheets in a direction parallel to the exposed edge of said floor.

3. Equipment in accordance with claim 1 further comprising means for expanding said sealing sheets laterally.

4. Equipment in accordance with claim 3 wherein said means for expanding said sealing sheets laterally comprises at least one generally rectangular casing, a block disposed within said casing, a strip of elastic sealing material attached to said block for engaging a portion of one of said grooves in said underwater structure, and an inflatable air chamber disposed within said casing to apply pressure to said block and press said block and said strip of elastic sealing material against said portion of said groove.

5. Equipment in accordance with claim 3 wherein said means for expanding said sealing sheets include a rectangular casing, a block disposed within said rectangular casing, and an inflatable air chamber disposed within said casing and cooperative with said block to displace said block outwardly and press said block against said portion of said groove, said block being made at least partially of an elastic material.

* * * * *

UNITED STATES PATENT AND TRADEMARK OFFICE

CERTIFICATE OF CORRECTION

PATENT NO. : 4,696,597

DATED : September 29, 1987

INVENTOR(S) : Willy SONCK

It is certified that error appears in the above-identified patent and that said Letters Patent is hereby corrected as shown below:

Column 1, line 15, after "e.g." insert a comma.

Column 1, line 42, after "casings" insert a comma.

Column 1, line 43, after "sheets" insert a comma.

Column 1, line 44, change "On" to --In--.

Column 1, line 44, after "casing" insert a comma.

Column 1, line 53, change "of" to --for--.

Column 2, line 28, change "Figures" to --figures--.

Column 2, line 59, change "large" to --larger--.

Column 3, line 44, change "beam" to --beams--.

Column 5, line 4, after "Finally" insert a comma.

Signed and Sealed this

Tenth Day of January, 1989

*Attest:*

DONALD J. QUIGG

*Attesting Officer*

*Commissioner of Patents and Trademarks*